United States Patent [19]

Perbet et al.

[11] Patent Number: 4,915,231

[45] Date of Patent: Apr. 10, 1990

[54] PACKAGING FOR PACKAGING OF PRODUCTS UNDER A TRANSPARENT FILM, PROCESS FOR PERFORMING THIS PACKAGING AND DEVICE FOR USING THIS PROCESS

[75] Inventors: Gerard Perbet; Daniel Perbet, both of Villeurbanne, France

[73] Assignee: Societe Villeurbannaise D'Emballages Modernes SVEM, Villeurbanne, France

[21] Appl. No.: 169,589

[22] Filed: Mar. 17, 1988

[30] Foreign Application Priority Data

Mar. 17, 1987 [FR] France ..... 87 04182

[51] Int. Cl.[4] ..... B65B 11/52

[52] U.S. Cl. ..... 206/461; 53/427; 53/477

[58] Field of Search ..... 206/461; 53/427, 477

[56] References Cited

U.S. PATENT DOCUMENTS 2,912,805 11/1959 Maynard, Jr. ..... 53/427
3,797,658 3/1974 Peacock ..... 53/427 X
3,860,117 1/1975 Walus et al. ..... 53/427 X
4,321,781 3/1982 Hall ..... 53/427

FOREIGN PATENT DOCUMENTS 1030845 5/1966 United Kingdom ..... 206/461

*Primary Examiner*—Arnold Rosenthal
*Attorney, Agent, or Firm*—Browdy and Neimark

[57] ABSTRACT

Packaging for packaging of products under a transparent film, a process for performing this packaging and a device for using this process. The packaging comprises a plate of cardboard or the like intended for supporting at least one product to be packaged, whose face receiving the product or products receives a coating of a layer of synthetic material, a first sheet of synthetic material for covering the upper face of the plate and the product or products resting on it. The first sheet is attached to the plate by being heated and partial vacuum being applied through the plate, and projects beyond the peripheral edge of the plate. A second sheet of synthetic material covers the lower face of the plate and is attached to the upper covering sheet by the peripheral edges of each sheet to one another beyond the edge of the plate. The packaging provides a tamperproof packaging making display of the packaged product possible.

6 Claims, 4 Drawing Sheets

PACKAGING FOR PACKAGING OF PRODUCTS UNDER A TRANSPARENT FILM, PROCESS FOR PERFORMING THIS PACKAGING AND DEVICE FOR USING THIS PROCESS

BACKGROUND OF THE INVENTION

This invention relates to a packaging for packaging of products under a transparent film, process for performing this packaging and device for using this process.

FIELD OF THE INVENTION

It is customary to package consumer products on a support or in a packaging making it possible to suspend the product on a display hook, assuring both the display of the product and its protection.

THE PRIOR ART

A first packaging known under the name SKIN-PACK comprises a cardboard plate whose face, intended to receive the product, is coated with a layer of synthetic material, such as polyvinyl chloride. After placing of the product on the plate, a sheet of synthetic material, brought to the temperature at which the material is malleable, is applied to the face of the plate on which the product is to be placed, while suction is performed through the plate. Because of the malleable nature of the sheets, it takes the shape of the product and supports it against the plate, while adhering to it, considering the temperature at which it is found.

If such a packaging is simple and economical to make, it has the drawback of not assuring a good protection of the packaged product from theft, considering the ease of separation of the cardboard plate and the sheet of synthetic material covering it.

Another packaging known under the name blister comprises a cardboard plate coated with a film of synthetic material, such as polyvinyl chloride and a shell of synthetic material such as rigid polyvinyl chloride molded to the shape of the product.

After positioning of the product in the shell, the shell is attached hot to the plate by pressure. A first drawback of this technique is in the cost of using it since it is necessary to have a mold per product to be packaged, this mold being intended to perform the molding by thermoforming of the plate of rigid synthetic material. Further, the product is not attached to the plate since there is a certain play between it and the shell of synthetic material, the display of the product through the shell is average, and it is not possible to touch it through the shell. Finally, this packaging does not exhibit a serious tamperproof character because of the possibilities of separation of the shell and cardboard.

Another packaging called a double-shell packaging comprises a lower shell in which the product is placed, a plate being placed, without being attached there, between two shells or between a shell and a plate of synthetic material, for example of rigid polyvinyl chloride, solidly connected with one another at their periphery by a high-frequency sealing operation.

If this packaging has the advantage of being more tamperproof than that of the preceding packagings, it has the drawback of very expensive use since it is necessary to have specific molds for each product for thermoforming of the shells, and it requires a sophisticated sealing installation. Other drawbacks of the packaging reside in the fact that it is bulky, that the plate does not adhere to the shells and that the package product does not adhere to the plate.

SUMMARY OF THE INVENTION

The present invention has as its objects to remedy these drawbacks, by providing a packaging that is simple in design, of low use cost, providing excellent assurance against tampering with the packaged products, while making possible an excellent display of these products.

For this purpose, the packaging to which it relates comprises:

a plate of cardboard or the like intended to serve as a support for one or more products to be packaged, whose face for receiving the product or products receives a coating of a layer of synthetic material, a first sheet of synthetic material which, intended to cover the upper face of the plate and the product or products resting on it, being attached to the plate, under the action of heat and with the application of a partial vacuum the plate, projects beyond the peripheral edge of the plate, and a second sheet of synthetic material which is intended to cover the lower face of the plate and is attached to the upper covering sheet by a peripheral sealing to the upper sheet beyond the edge of the plate.

As a result of its structure, the packaging according to the invention exhibits all the advantages of packaging of the Skinpack type, since the plate adheres to the upper covering sheet, which closely fits the product or products placed on the plate, while providing excellent assurance against tampering because of the peripheral seal made between the upper and lower covering sheets.

To the extent that the packaging comprises an opening for suspension on a display hook, an opening is made in the plate before attachment of covering sheets, and sealing is performed between upper and lower covering sheets short of the edge of the opening made in the plate. The latter seal prevents any risk of separation of the upper sheet and the plate from the opening.

The upper and lower covering sheets advantageously are made of the same material.

Preferably the constitutive material of the upper and lower covering sheets is selected to achieve a bonding of the latter by heat sealing or by pulse sealing.

For example, the opposite faces of the upper and lower covering sheets can have a base of polyethylene, of ionomer resin known, for example under the trademark SURLYN, or of a butadienestyrene copolymer such as those known under the trademarks K-RESIN and STYROLUX. These products offer the advantage, relative to PVC, of allowing sealing with simply techniques and recovery of material scraps.

According to a first possibility the plate on which the product is placed is planar.

According to another possibility, the plate on which the product to be packaged is placed comprises a peripheral edge obtained by cutting and grooving the side from which the plate is cut, and folding the edge 90°, this edge being covered by the upper covering sheet, which assures that its shape is kept. Such a solution makes possible a better use of the packaged products because of their display in a packaging forming a case.

In case many packagings are made at the same time they are covered with the same upper covering sheet and the same lower sheet, the packagings being separated from one another during the operation of sealing of the upper and lower sheets.

A process for making this packaging consists in placing one or more products on a plate whose upper face is coated with a layer of synthetic material, in covering the plate with an upper covering sheet of synthetic material, with a surface greater than that of the plate, putting the sheet and plate in contact being performed after the sheet has been brought to its softening temperature and by exerting a partial vacuum through the plate, then in covering the plate with a lower covering sheet, and finally in sealing the upper and lower covering sheets beyond the peripheral edge of the plate.

In case the plate comprises a peripheral edge, it is first positioned on the inside of a frame assuring the shaping of the edges, from which it is removed before sealing of the lower covering.

A device for using the process comprises, from upstream to downstream:

a first station where several plates are positioned on the same tray, a second station where each tray is brought into contact with the upper covering sheet and where fastening of this sheet to the plates resting on this tray is performed, and a third station where the upper covering sheet solidly connected with the plates carrying the products in sealed to the lower covering sheet with simultaneous cutting of the two sheets to separate the packagings from one another.

Advantageously, this device comprises a horizontal roll placed upstream from the second station, from which the upper covering sheet is unwound to the downstream end of the machine, and a second roll parallel to the first, placed between the second and third station, from which the lower covering sheet is unwound to the downstream end of the machine, the second station being associated with a vertical transfer device making it possible bring a tray in contact with the upper sheet by making a partial vacuum through the tray, before redescent and evacuation of the tray, the plates previously placed on the tray remaining solidly connected with the upper sheet and being brought by the latter above the lower covering sheet, the two sheets being assembled by sealing at the third station with simultaneous cutting of the packagings, the packagings being evacuated downstream from the third station, a zone in which evacuation of the scraps of material is performed, for example, by winding on a roll.

BRIEF DESCRIPTION OF THE DRAWINGS

In any case, the invention will be better understood with the help of the following description, with reference to the accompanying diagrammatic drawings representing, by way of nonlimiting examples, several embodiments of this packaging and a device for using the process for making this packaging, in which.

DETAILED DESCRIPTION OF THE PREFERRED EMBODIMENTS

Figure 1:
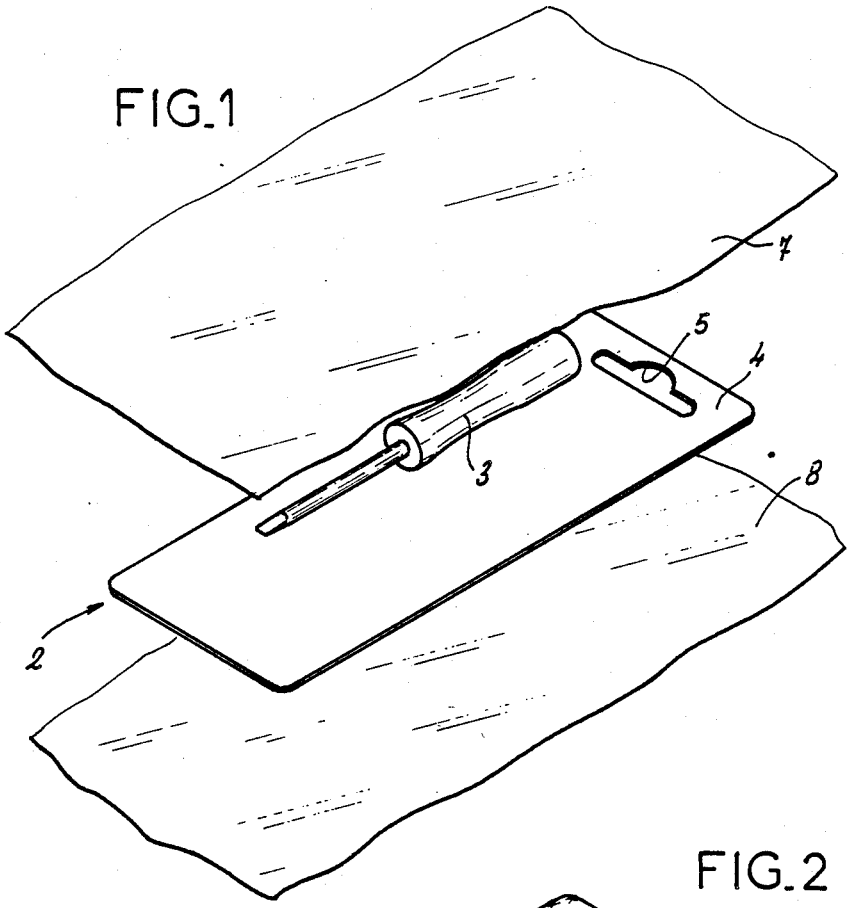
FIG. 1 is an exploded perspective view of a first packaging.
Figure 2:
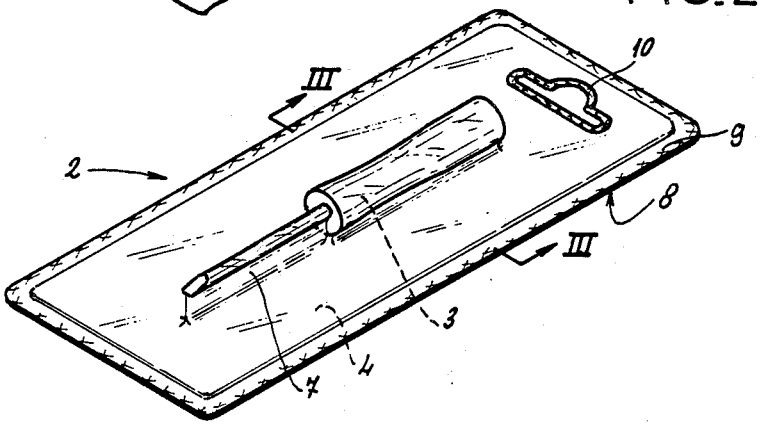
FIG. 2 is a perspective view in finished position.
Figure 3:
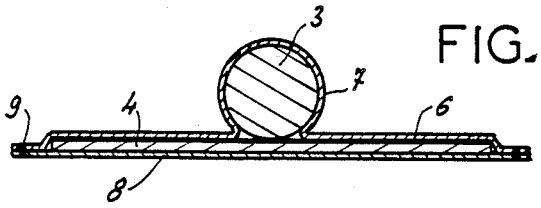
FIG. 3 is a view in cross section along line III—III of FIG. 2.

The packaging represented in FIGS. 1 to 3, and designated by general reference 2, is intended for packaging a tool consisting, in this case, of a screwdriver 3. This packaging comprises a cardboard plate 4 whose upper face receives, by printing, decorative motifs and/or indications on the description and use of the tool. This plate 4 which exhibits an opening 5 intended for suspension of the packaging on a hook, is coated on its upper face with a layer 6 of synthetic material. With this plate 4 is associated an upper covering sheet 7 and a lower covering sheet 8, each with a surface greater than that of the plate. In a first time, upper covering sheet 7 is brought to its softening temperature by raising the temperature, and is applied to plate 4 by creating a partial vacuum through the latter. Sheet 7 then fits the tool and adheres to plate 4. Sheet 8 is then fastened to sheet 7 by a peripheral sealing 9 made by raising the temperature or by pulses, this sealing 9 being made on the outside of the peripheral edge of plate 4. Further, a sealing 10 between the two sheets is made short of opening 5 of plate 4.

Such a packaging offers the advantage that the tool adheres to plate 4, that sheet 7 also adheres to plate 4 and fits the shape of the tool, and that the sealing between the two sheets 7 and 8 provides excellent assurance against tampering with the packaging.

Figure 4:
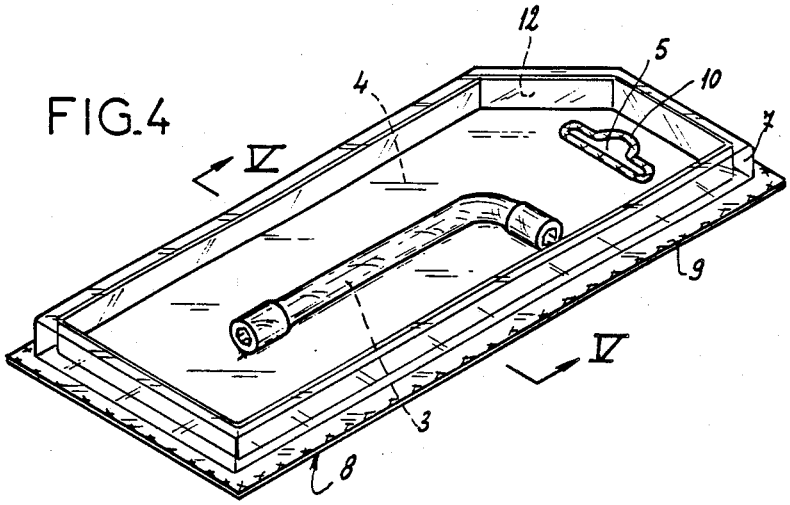
FIG. 4 is a perspective view of a second packaging.
Figure 5:
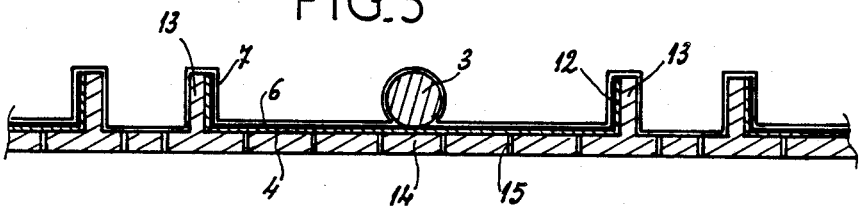
FIG. 5 is a view in cross section along line IV—IV of FIG. 4 of this packaging during production.

FIG. 4 represents a variant embodiment of the packaging of FIGS. 1 to 3 in which the same elements are designated by the same reference as above. This packaging differs from the preceding one in that plate 4 comprises a peripheral edge 12 forming an angle with the plane of the plate, this edge 2 being kept in place by upper covering sheet 7. For this purpose and as FIG. 5 shows, a tray intended for positioning of several plates 4, comprises, at each plate a peripheral frame 13 assuring the shaping of edges 12 and their holding before placing of upper covering sheet 7. The tray carrying reference 14 comprises perforations 15 making it possible to create a partial vacuum through plates 4 during the operation of placing the upper covering sheet on the plates.

Figure 6:
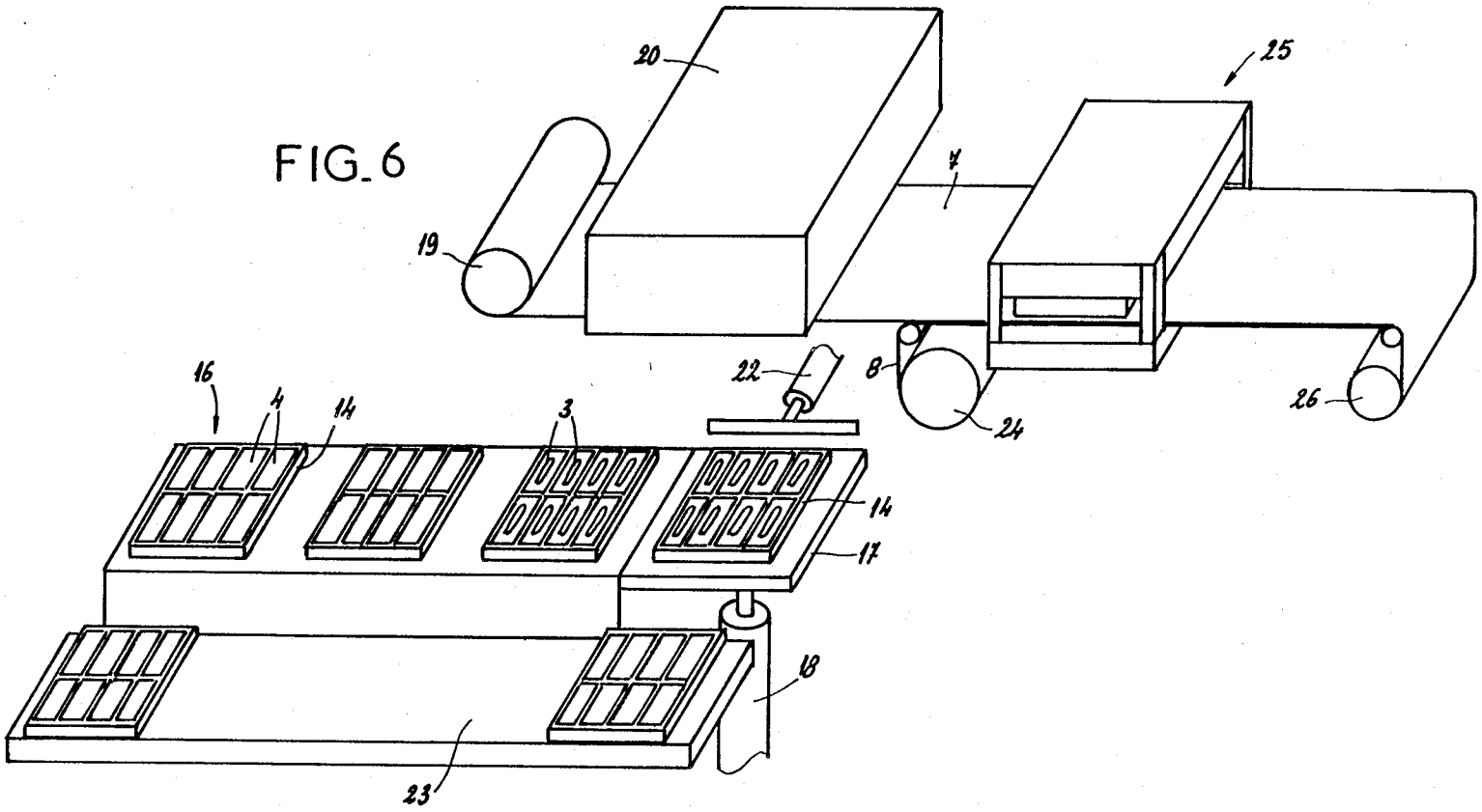
FIG. 6 is a very diagrammatic perspective view of a device for production of packagings.
Figure 7:
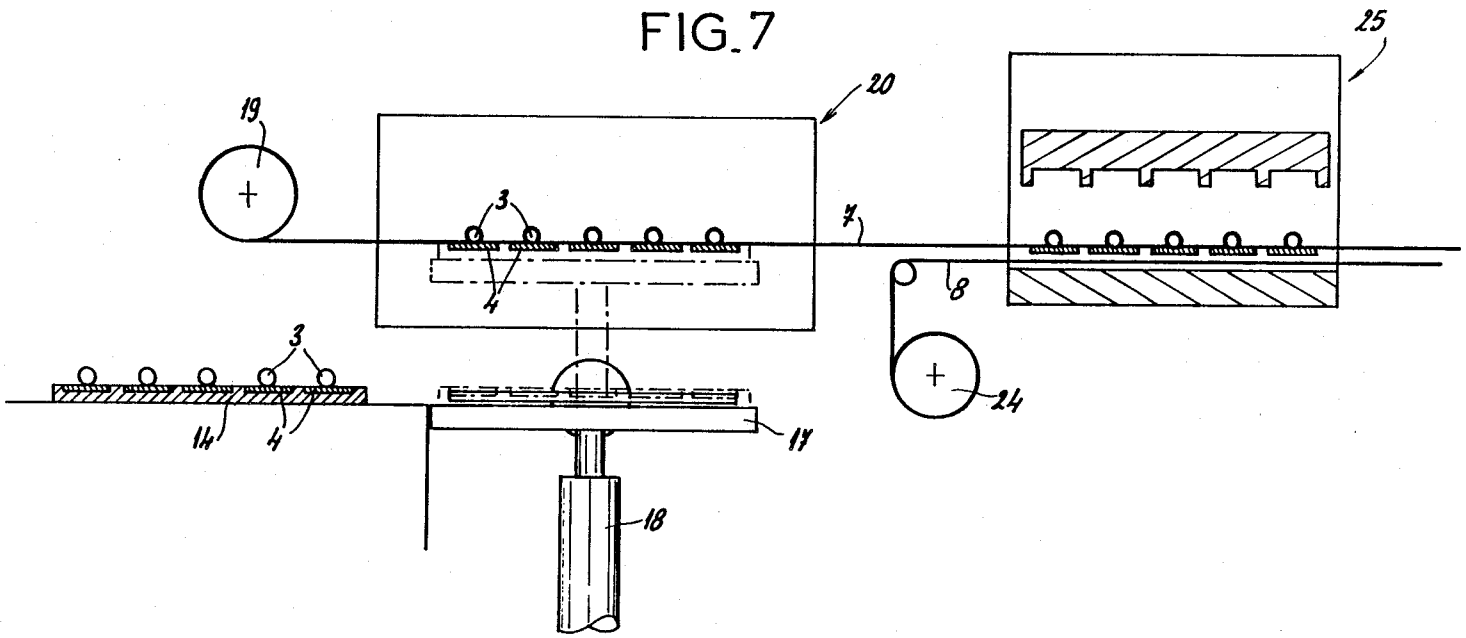
FIG. 7 is a view in longitudinal section of the device of FIG. 6.

FIGS. 6 and 7 represent a device for making these packagings, seen respectively in perspective and longitudinal view. This device comprises a first station 16 where trays 14 intended to receive several plates 4 are positioned by pins (not shown in the drawing) or by frames 13, are charged with products 3. Each tray 14 is then moved to be brought onto a support 17 associated with a lifting cylinder 18. By upward vertical movement support 17 brings tray 14 in contact with an upper covering sheet 7 unwound from a roll 19. The contact between a tray 14 and sheet 7 is performed at a heating unit 20 bringing the material of the sheet to a malleable state with creation of a partial vacuum through support 17. As shown in FIG. 7, support 17 and the tray which carries it are then moved downward, the various plates 4 and the products that they support remaining fastened to upper covering sheet 7. When support 17 has arrived in the low position, an ejector cylinder 22 releases the empty tray to an evacuation device 23.

By movement of covering sheet 7, the products and plates to which they are fastened are brought above lower covering sheet 8, which is unrolled from a roll 24 placed downstream from heating unit 20. Downstream from roll 24 is placed a unit 25 performing, on the one hand, the sealing of sheets 7 and 8 at the periphery of plates 4 and, on the other hand, cutting of the packagings thus performed. It should be noted that the scraps of upper and lower covering sheets are wound on a motorized roll 26, which also assure unwinding of sheets 7, 8 of rolls 19 and 24.

It is clear from the above that the invention makes a great improvement in the existing technique by providing a packaging simple in design, assuring excellent protection of the packaged products, and having good assurance against tampering, while being obtained by a process and a device very economical to use.

We claim:

1. A packaging for packaging products, comprising:

a plate of rigid material intended to serve as a support for at least one product to be packaged, said plate having a lower face and an upper face, said upper face adapted to receive said at least one product, said plate having a coating of a layer of synthetic material and having means for passing air through side plate and said coating in response to a partial vacuum across said plate;

a first upper sheet of synthetic material for covering and adhering to the upper face coating of said plate and said at least one product resting on it, adapted to be attached to said plate coating and said at least one product under the action of heat and said means for passing air through said plate in response to application of said partial vacuum across said plate, and projecting beyond a peripheral edge of said plate; and a second lower sheet of synthetic material for covering the lower face of said plate and being attached to said first upper covering sheet by a peripheral sealing to said first upper covering sheet beyond the edge of said plate.

2. The packaging according to claim 1, wherein said plate comprises an opening for suspension of the package from a display hook, and wherein said upper and lower covering sheets are sealed together near of the edge of said openining made in the plate.

3. The packaging according to claim 1, wherein said upper and lower covering sheets are made of the same material.

4. The packaging according to claim 3, wherein the material of said upper and lower covering sheets is selected to achieve a bonding between them by heat sealing or by pulse sealing.

5. The packaging according to claim 1, wherein said plate on which the product is placed is planar.

6. The packaging according to claim 1, wherein said plate on which the at least one product to be packaged is placed comprises a peripheral edge forming an angle with the plane of said plate, said peripheral edge being covered by said upper covering sheet, which assures that its shape is maintained.

* * * * *